United States Patent [19]

Ono

[11] Patent Number: 4,777,642

[45] Date of Patent: Oct. 11, 1988

[54] X-RAY TUBE DEVICE

[75] Inventor: Katsuhiro Ono, Kawasaki, Japan

[73] Assignee: Kabushiki Kaisha Toshiba, Kawasaki, Japan

[21] Appl. No.: 886,674

[22] Filed: Jul. 18, 1986

[30] Foreign Application Priority Data

Jul. 24, 1985 [JP] Japan ..... 60-163159

[51] Int. Cl.[4] ..... H01J 35/14

[52] U.S. Cl. ..... 378/138; 378/136; 378/113

[58] Field of Search ..... 378/136, 138, 139, 113; 313/361.1, 241, 270, 447

[56] References Cited

U.S. PATENT DOCUMENTS 4,126,805 11/1978 Randall ..... 378/138
4,698,835 10/1987 Ono et al. ..... 378/136

FOREIGN PATENT DOCUMENTS 0163321 12/1985 European Pat. Off. ..... 378/138
55-68056 5/1980 Japan .
59-94348 5/1984 Japan .

*Primary Examiner*—Janice A. Howell

*Assistant Examiner*—David P. Porta

*Attorney, Agent, or Firm*—Oblon, Fisher, Spivak, McClelland & Maier

[57] ABSTRACT

An X-ray tube has a cathode assembly for emitting an electron beam and an anode target facing this assembly in an evacuated envelope. The anode target defines a target surface that is slightly inclined to the electron beam axis and the direction in which it is inclined coincides with an X-ray irradiation direction. The cathode assembly comprises a flat cathode with a flat electron emission surface and a focussing electrode which focuses electrons emitted by the cathode. The cathode's electron emission surface is elongated and its long axis is coincident with the direction of X-ray irradiation. The focussing electrode possesses an axially symmetric opening with generally the same dimensions lengthways and crosswise. This gives an X-ray tube device in which the shape of the X-ray focal spot seen looking from the X-ray irradiation direction is substantially that of a circle or of a polygon, including a square, and it is possible to vary the size of the X-ray focal spot over a wide range while maintaining its long to short side ratio at 1.4 or less.

8 Claims, 8 Drawing Sheets

X-RAY TUBE DEVICE

BACKGROUND OF THE INVENTION

The present invention relates to an X-ray tube device which can produce X-ray focal spots of generally the same shape and of any size required in accordance with the type and size of a body that is examined and can produce a tube current of any required magnitude in correspondence to the size of the X-ray focal spot.

Generally, X-ray tube devices are used in medical applications such as X-ray diagnosis, for example, The devices used conventionally for examination of the stomach, etc. are rotating anode X-ray tubes. In an X-ray tube such as this, a cathode assembly and a disk shaped anode target are offset from the tube axis and face one another in an evacuated envelope and the anode target is arranged so that it is rotated by a rotor which is rotatably driven by electromagnetic induction produced by a stator.

The cathode assembly has a structure such as shown in FIG. 10 in which a cathode filament 11 is disposed in a focussing dimple 16 of a focussing electrode 12. Cathode filament 11 is constituted by a tungsten coil so that it may emit thermoelectrons, and these thermoelectrons are focussed by electric field formed by cathode filament 11 and focussing electrode 12 being brought to the same potential in order to achieve this. In the figure, dashed lines 13 represent the equipotential curves in the vicinity of focussing electrode 12, 14 the loci of electrons emitted from a generally central portion of cathode filament 11 and 15 the loci of electrons emitted from locations near the side surfaces of cathode filament 11.

Cathode filament 11 is generally used in a temperature limited region in the above prior art cathode assembly, and so in order to increase the field intensity in the vicinity of cathode filament 11, a portion of the cathode is protruded into the focussing dimple 16. As a result, the equipotential plane in the vicinity of cathode filament 11 takes a form that bulges at the centre of cathode filament 11, as indicated by dashed line 13*a*, and electrons 15 emitted from the substantially side walls of cathode filament 11 are directed sideways. These electrons 15 are not focussed in the same direction as electrons 14 that are emitted from the substantially central portion of cathode filament 11 and are directed forwards but, as shown in FIG. 10, have loci that intersect on the axis. Therefore, the electron intensity distribution at a surface of the anode target 13 is not uniform, showing for example twin peaks in FIG. 10.

Since it is thus not possible for the focussing electrode 12 to effect satisfactorily tight focussing of electrons emitted from cathode filament 11, achieving a small X-ray focal spot at the location of anode target 13 necessitates use of a small cathode. This in turn means that there is a problem of cathode filament 11 reliability, since it is not possible to produce electrons at satisfactorily high density without raising the cathode temperature.

Further, it is not possible to produce a very fine X-ray focal spot since electrons are not all advancing in the same direction at the location of anode target 13. Thus, since there is no sharpness in the electron distribution and it is not possible to achieve a required electron distribution, it is impossible to achieve a satisfactorily high degree of spacial resolution of X-ray image obtained by using these conventional X-ray tubes. Also, it is not possible to simultaneously satisfy the two requirements X-ray focal spot is made smaller by lowering the maximum temperature rise caused by impingement of electrons into small area on anode target 13 and that the amount of incident electrons are increased. As they constitute an obstacle to improvement of spacial resolution and reduction of photon noise, these facts prevent production of a satisfactorily clear image in production of a projected image by X-rays emitted from anode target 13.

A method one can think of for eliminating this drawback is to use a cathode filament in the form of a flat plate.

An example of this is the proposal disclosed in Japanese Laid-open Patent Application No. 55-68056.

To describe the example of prior art that is shown in FIG. 11 and employs such a cathode constituted by a strip-like flat plate 21 is a cathode filament which is constituted by a strip-like flat plate and formed into a shape $\pi$ and which is mounted on filament support posts (not shown) and is directly heated and emits thermoelectrons on connection of power. 22 is a focussing electrode which has a shallow focussing dimple depth (H) and serves to focus electrons that exist from cathode filament 21. 23 indicates equipotential curves in the vicinity of focussing electrode 22. An anode target, indicated by the reference numeral 28, is maintained at a high positive potential with respect to cathode filament 21 and focussing electrode 22 and is located at a point that is coincident with the focal distance of the electron lens constituted by the focussing electrode.

However, this prior art example has the following drawbacks.

The loci of electrons 25 exciting from side surfaces of cathode filament 21 and of electrons 24 exciting from the central portion are very different and the electron distribution 27 on anode target 28 has secondary X-ray focal spots as indicated in FIG. 11. The reason for this is that the loci of electrons exiting from end portions of cathode filament 21 constituted by a strip-like flat plate is as indicated by the line 29 in FIG. 13. Dashed curve 30 indicates the equipotential curve at a location that is very close to the surface of cathode filament 21 and, as seen in the figure, it has a distribution which sags in the gaps 31 between the end portions of cathode filament 21 and focussing electrode 22, so producing local concave lenses. As a result, the loci 29 of electrons emitted from locations near to the end portions of cathode filament 21 are closer to the walls of focussing electrode 22 than they would be if the equipotential curve 30 were uniform. Further, the equipotential curves 23 in focussing electrode 22 are more curved near the walls of focussing electrode 22 than in the central portion of focussing electrode 22, so resulting in aberration, since the focal distance with loci 29 is shorter than it is with 24, and it is thus not possible to achieve a satisfactory degree of focussing. When the value of current becomes larger, electron beam distribution width on the target surface is changed to a larger value than in small current case, because of space charge effects.

When the focussing electrode is brought to the same potential as the filament and, in order to achieve a greater focussing effect, the focussing electrode 22 depth H is made large and f is made small keeping the anode to cathode distance the same, the field in the vicinity of cathode filament 21 becomes weaker, so resulting in a space charge limited state and variation in the value of current depending on the anode potential.

In some cases it is not possible to get a current of more than 10 mA when the anode voltage is of the order of 30 kV.

There is an example of a structure in which a bias voltage that is positive with respect to cathode filament 21 is applied to focussing electrode 22 or on an electrode with a shallow focussing dimple that is located a little forward of this, but one can expect this to result in poor electron beam focussability in the direction of cathode filament (in the direction normal to the plane of FIG. 11). Basically, therefore, the abovenoted disclosed and published art gives no indication of how to make it practically possible to freely change the width of electron beam on the anode target while maintaining a similar beam width ratio in axial and transversal directions.

In this example, one would anticipate that it is not possible to change the size of an X-ray focal spot while maintaining a similar shape unless bias voltages of different values are applied independently going in the direction of length and the direction of width of the cathode filament as taught in another example, Japanese Laid-open Patent Application No. 59-94348.

A conventional example of means for producing X-ray focal spots of different sizes while keeping the X-ray focal spot shape almost constant is that disclosed in Japanese Laid-open Patent Application No. 59-94348 in which independent voltages are applied in two directions that cross at right-angles and correspond to directions going along the length and the width of the X-ray focal spot. This means has a construction such as shown in FIG. 12 by way of example namely separated two pairs of electrodes so that, individual voltages are applied to upper and lower electrodes 33 and left and right electrodes 34 surrounding a rectangular flat filament electrode 21. Producing a required X-ray focal spot in this example necessitates imposition of individual voltages in the direction of length (up to down) and in the direction of width (left to right). The X-ray tube construction is therefore complex, a greater number of high voltage cable core strands is needed and selection of requisite voltages in use of the equipment is difficult. Further, it is not possible to get a X-ray focal spot with sharp edges in this example, because of electrons from side surfaces of the cathode as described earlier. Also, because of the field at electrode corner portions, changes in bias voltage are accompanied by changes in the shape of corner portions of the X-ray focal spot.

SUMMARY OF THE INVENTION

It is an object of the present invention to provide an X-ray tube device which permits the size of an X-ray focal spot to be changed over a wide range while still maintaining a similar X-ray focal spot shape.

In more detail, the X-ray tube device of the invention is one in which, in an X-ray tube device comprising an X-ray tube which has an evacuated envelope having provided therein a cathode structure, which emits an electron beam and consists of a flat cathode for emitting electrons and an electron beam forming electrode that focuses electrons emitted by the flat cathode, and an anode target which has a target surface that faces the cathode structure, is strikable by the electron beam and is disposed so that it is inclined with respect to the electron beam axis and can emit X-rays in along an X-ray irradiation axis and voltage applying means which, taking the flat cathode as a reference, applies a positive voltage to the anode target and applies a positive bias to the electrode beam forming electrode.

The cathode possesses a flat electron radiation surface extending in the direction of the X-ray irradiation axis.

Provided therearound, a potential flattening electrode is located on substantially the same plane as the electron radiation surface to flatten the potential and in the vicinity of the electron radiation surface.

The electron beam forming electrode comprises an electron beam transit hole located in the vicinity of the cathode and a focussing channel which extends from the transit hole towards the anode target and has a shape which is larger than that of the transit hole, the electron beam transit hole and focussing channel define circles or polygonal shapes having at least four sides and the length of one side-to-side dimension of the electron beam transit hole is made greater than the length of a short side of the electron radiation surface.

In the invention, the shape of the X-ray focal spot as seen from the direction of X-ray radiation is substantially circular or square or a shape with a long side that is at most 1.4 times the length of the short side, and it is possible to change the size of the X-ray focal spot in accordance with radiation conditions over a wide range, e.g., 0.1 mm or less to 1.5 mm or more, while constantly keeping a similar shape. Changing the X-ray focal spot is easily effected by variable setting of a single bias voltage in correspondence to previously set X-ray focal spot sizes.

DETAILED DESCRIPTION OF THE PREFERRED EMBODIMENTS

An embodiment of a rotating anode X-ray tube device in which the invention is applied will be described with reference to FIGS. 1 through 9.

Figure 1:
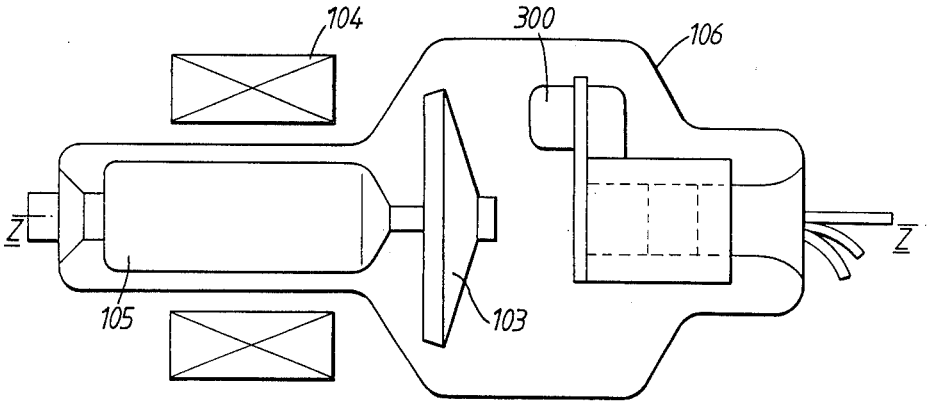
FIG. 1 is a schematic view showing the construction of an X-ray tube to which this invention is applied.
Figure 2:
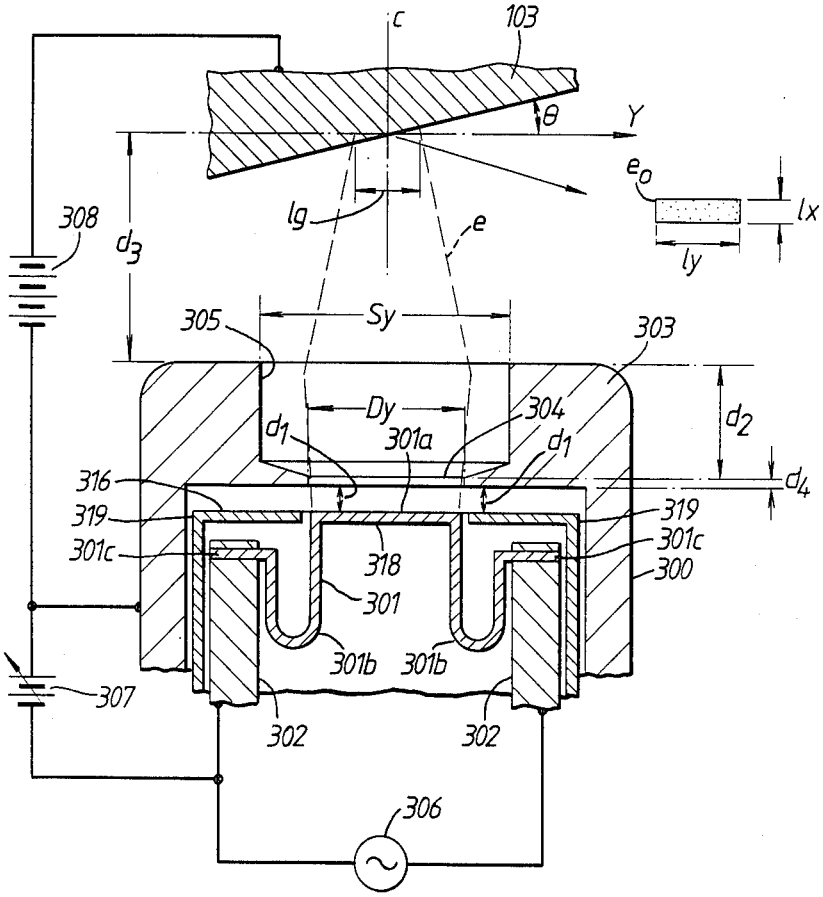
FIG. 2 is a sectional view taken along a radial plane of the X-ray tube including the center axis C of an electron beam in FIG. 1, which shows an anode target and a cathode structure according to an embodiment of this invention.

As shown in FIG. 1, a rotating anode X-ray tube 101 comprises an evacuated envelope 106 at one end of which there is fixed a cathode assembly 300 that is positioned off-centre with respect to the tube axis Z. A disk type anode target 103 facing assembly 300 is mounted at the other end of envelope 106 via a rotor 105. A stator 104 is mounted outside envelope 106 and surrounding rotor 105. A rotating magnetic field produced by stator 104 drives rotor 105 and causes anode target 103 to rotate.

This embodiment is an example of application to an X-ray tube in which the anode voltage is 30 kV, the anode current is 30 mA and the X-ray focal spot is varied in the range 50 μm–1 mm. This is achieved by the configuration shown in FIGS. 2–5 in which an anode target 103 and a cathode assembly 300 facing it are provided in an X-ray tube evacuated envelope not shown in these drawings. In cathode assembly 300, a directly heated cathode filament 301 is mounted on support posts 302. Cathode filament 301 in this case is constituted by a strip-like flat plate, e.g., a thin plate of a heavy metal such as tungsten, etc. with a width Cx of about 1 mm and a thickness of the order of 0.03 mm, and is formed as an elongated flat shape so that its central portion defines an electron radiation surface 301*a*, while its opposite side portions are bent at right-angles to define leg portions and then bent into U shapes to define fold-back portions 301*b* and 301*b* whose ends 301*c* and 301*c* extend outwards at right-angles and are electrically connected to filament support posts 302 and 302 by electron beam welding or similar procedure.

A circular-cup-shaped focussing electrode, or electron beam forming electrode 303 to which filament support posts 302 and 302 are fixed via insulating support posts (not shown) is provided surrounding cathode filament 301. In electron beam forming electrode 303, there is defined an electron beam transit hole 304 which lies opposite electron radiation surface 301*a* of cathode filament 301 and is formed as a square whose side is longer than the width Cx along the minor axis of electron radiation surface 301*a* or as a circle with a diameter greater than this width Cy or as a shape close to one of these shapes and is located about 0.7 mm (dimension d1) forward of electron radiation surface 301*a*, with its surface on the electron radiation surface 301*a* side substantially parallel to electron radiation surface 301*a*. A focussing channel 305 is formed in electron beam forming electrode 303 forward of and in continuation to electron beam transit hole 304. Focussing channel 305 defines, e.g., a square of side greater than the side or diameter of electron beam transit hole 304, is coaxial with electron radiation surface 301*a* and has quite a large depth d2 dimension. The bottom surface of focussing channel 305 is formed so that it tapers to electron beam transit hole 304 and the dimension of this taper surface along a line parallel to the axis (C) is only a small fraction of depth d2.

Electron emission surface 301*a* in cathode filament 301 defines a rectangle of width Cx and length Cy and its surface is made flat. Around electron emission surface 301*a*, there is provided a potential distribution flattening electrode 316 which is held at substantially the same potential as cathode filament 301 and has a surface that is on generally the same plane as electron emission surface 301*a*. A positive bias voltage applied to electron beam transit hole 304 results in definition of a concave electron lens by the equipotential plane defined by electron emission surface 301*a* and potential distribution flattening electrode 316 and electron beam transit hole 304. Since electron beam transit hole 304 is or is close to a square or a circle and the equipotential plane defined by electron emission surface 301*a* and potential distribution flattening electrode 316 is considerably larger than electron beam transit hole 304. The focal distance of this concave electron lens is always effectively the same in the direction of the major axis of cathode filament 301 (the y direction) and in the direction of the minor axis of cathode filament 301 (the x direction). If electron beam transit hole 304 is circular, a concave lens that is symmetrical with respect to axis C is formed.

Designating the angle defined between the target surface 103*a* of target 103 that is inclined to the electron beam axis and X-ray radiation axis along which X-rays are taken out as $\theta$, generally $\theta$ is 7–20°. The minor axis of a section $e_o$ of the electron beam immediately before it strikes target 103 will be designated as lx and the major axis of this section as ly. To consider the case widely accepted in the art in which the ratio of the long side and short side of the X-ray focal spot shape Xo seen looking along the X-ray radiation axis is 1.4 or less, the most preferrable state in terms of good spatial resolution is one in which the ratio is 1.0, giving a X-ray focal spot in the shape of a square. To achieve this, one must so arrange things that the shape of the area of electron beam impingement on the target surface satisfies the following conditions.

$$\frac{1y}{1x} = \frac{1}{\tan\theta} \tag{1}$$

Since a long and short side ratio of up to about 1.4 is permissible for the shape of the X-ray focal spot seen looking along the X-ray radiation axis, it is satisfactory if the long and short side ratio of the electron beam $e_o$ on the target surface is within the range $$\frac{1}{\sqrt{2}} \cdot \frac{1}{\tan\theta} \leqq \frac{1y}{1x} \leqq \sqrt{2} \cdot \frac{1}{\tan\theta} \tag{2}$$

Figure 8:
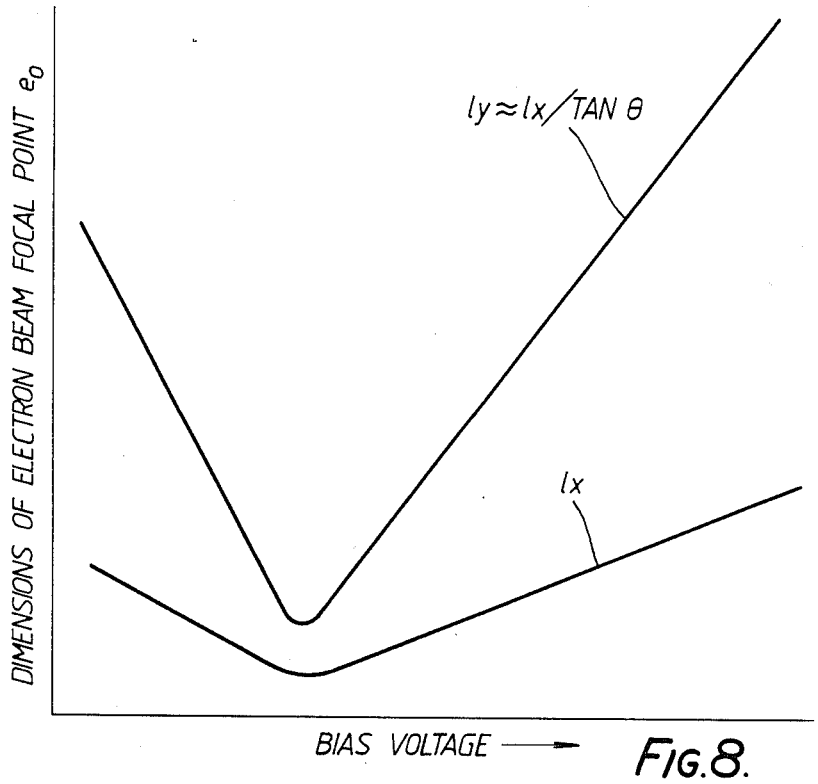
FIG. 8 is a graph showing the relation between the bias voltage applied to the electron beam forming electrode and the focal size of the electron beam.

These relations are plotted in FIG. 8.

Production of a minimum X-ray focal spot (e.g., with a side of 50 μm) at a set beam current corresponds to the time when the X-ray focal spot is formed in a manner such that the location where the electron beam waist in the short side or minor diameter direction, i.e., the cross-sectional dimension of the electron beam e, is minimum coincides precisely with the target surface. Downstream of the beam waist, the electron beam e gradually spreads and the cross-sectional dimension becomes larger because of mutual repulsion of electrons. The direction of the major axis of the beam shape of the target surface coincides with the X-ray radiation axis.

If a higher positive bias voltage with respect to cathode filament 301 is applied to the electron beam transit hole, the focal distance of the convcave electron lens becomes shorter and the focal distance of the combined convex lens becomes longer and one obtains a larger X-ray focal spot.

In this case, the arrangement becomes such that the location of the beam waist lies behind target 103, and as the bias voltage is higher the beam waist shifts further to the rear and electron beam size on the target surface becomes larger, with lx and ly continuing to meet the conditions of Eq. (2).

Figure 6:
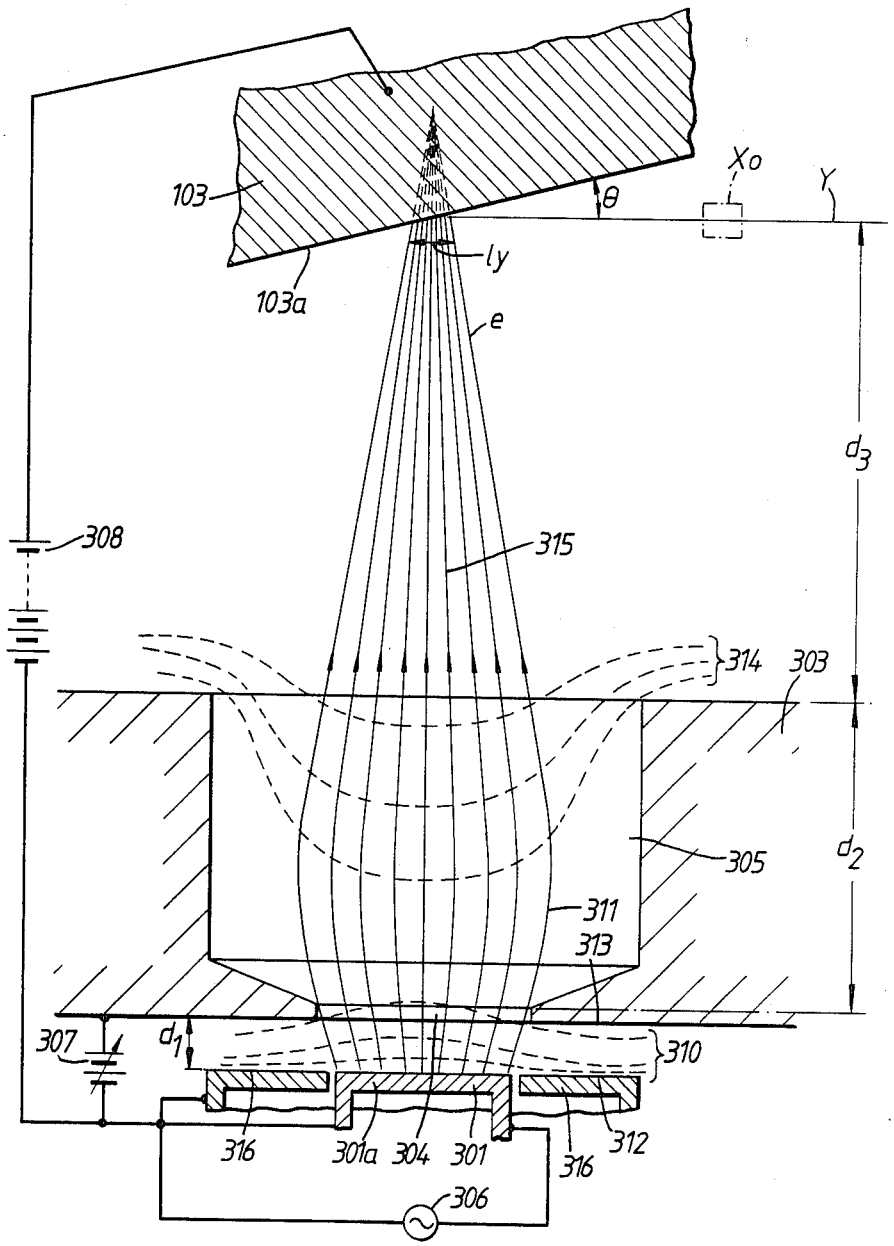
FIG. 6 is a view in which the loci of electron beams and the equipotential lines are shown in the section similar to that of FIG. 3 for explaining the operational mode in the X-ray tube device according to a first embodiment of this invention.

This action will be described with reference to FIGS. 6 and 7, which show the results of computer simulation of electron beam focussing states. FIG. 6 is a section corresponding to FIG. 2. As noted earlier, cathode filament 301 is constituted by a thin tungsten plate about 2 mm wide and 0.03 mm thick and it is supplied with power and heated via filament support posts 302. Thermoelectrons emitted from the surface of cathode filament 301 are accelerated by the field produced by the bias voltage applied cross electron beam transit hole 304 and cathode filament 301 and potential distribution flattening electrode 316 and reach electron beam transit hole 304.

Since the surface of cathode filament 301 and the surface of electron beam transit hole 304 and potential distribution flattening electrode 316 are generally parallel, the equipotential curves 310 present between them during this process are generally parallel and there is little irregularity in the loci of electrons passing through edge portions of electron beam transit hole 304. During their passage over stretch d1, electrons that have passed through electron beam transit hole 304 are dispersed by the action of the intervening concave lens but the density of the electron beam they define is very uniform. This electron beam is strongly focussed by focussing channel 305, which is of considerable depth and effects a strong convex lens action, and reaches target 103.

Figure 3:
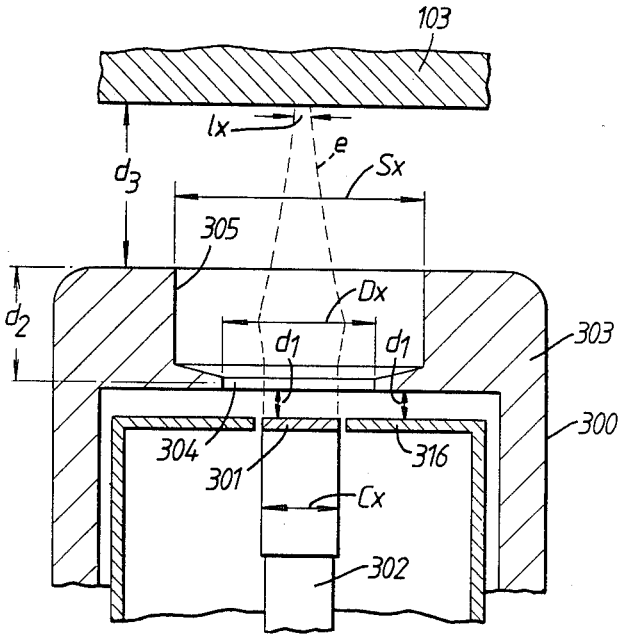
FIG. 3 is a sectional view taken along a plane perpendicular to the plane including both the center axis C of the electron beam in FIG. 1 and the axis Z of the X-ray tube, which shows the anode target and cathode structure shown in FIG. 2.
Figure 4:
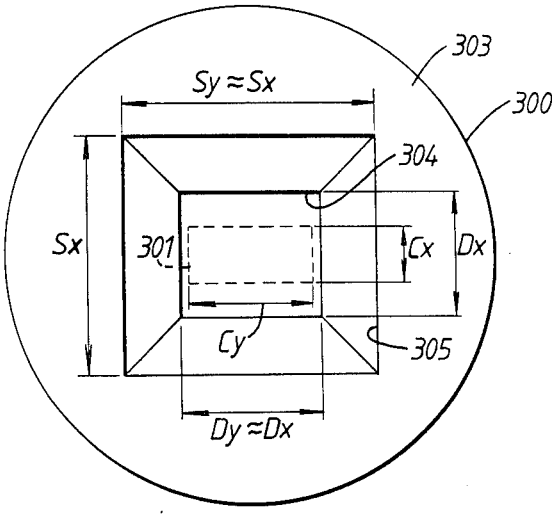
FIG. 4 is a plan view showing the electron beam forming electrode shown in FIGS. 2 and 3, in which, for comparison, the electron emitting portion of the filament is indicated by a broken line.
Figure 5:
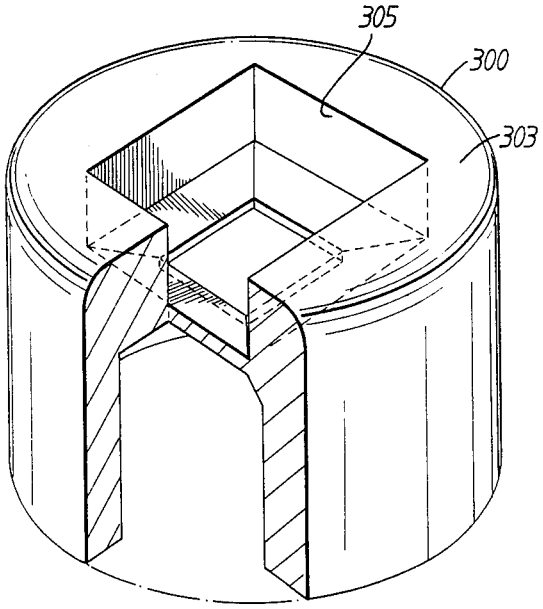
FIG. 5 is a perspective view, partly broken, of the electron beam forming electrode of FIG. 4.
Figure 7:
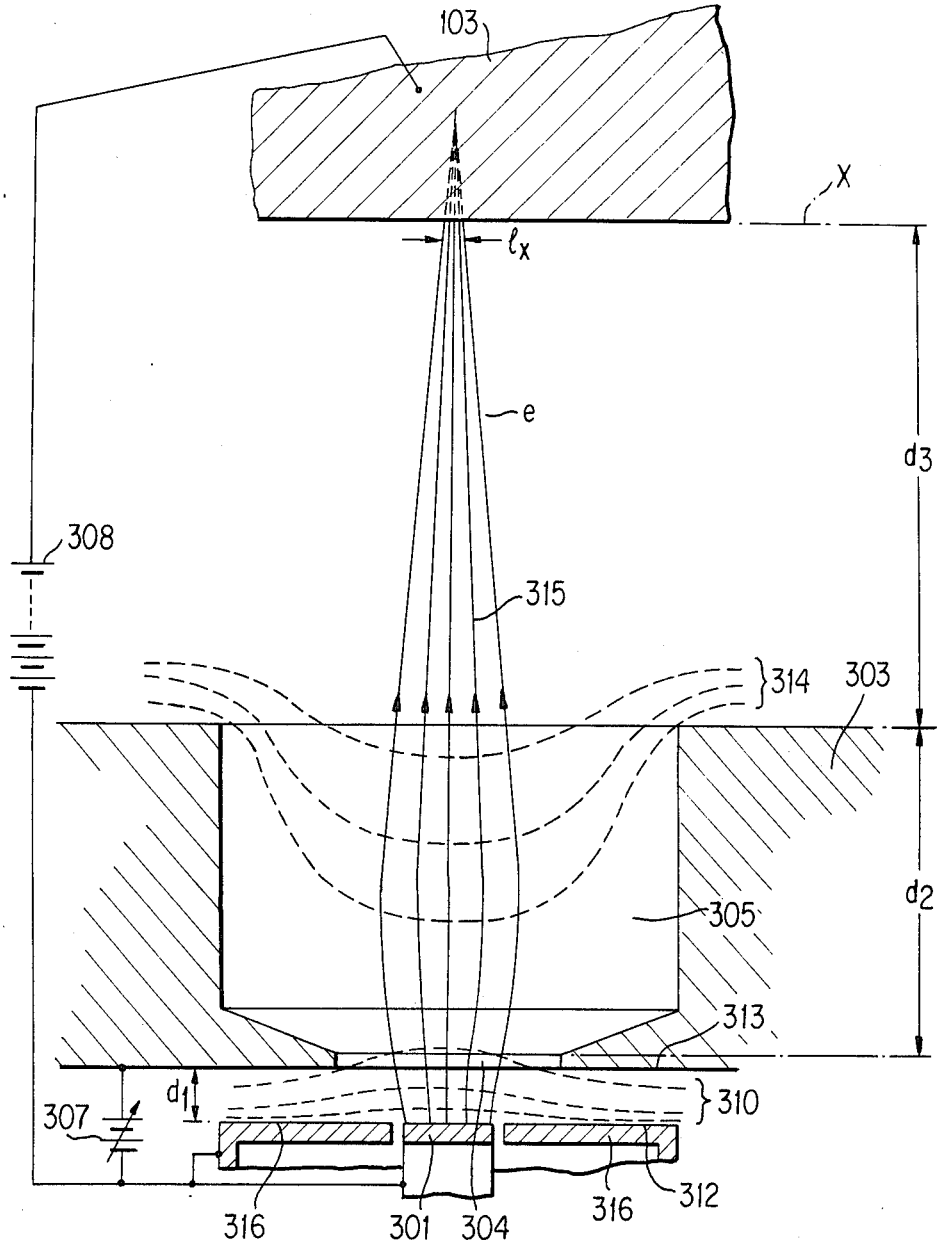
FIG. 7 is a view in which the loci of electron beams and the equipotential lines are shown in the section similar to that FIG. 3 for explaining the operational mode in the X-ray tube device according to the invention.

FIG. 7 is a cross-section corresponding to FIG. 3 and illustrates focussing along the short axis of cathode filament 301. A flat potential plane is formed over a wide area of electron emission surface 301*a* and potential distribution flattening electrode 316 since they are at substantially the same potential and are in the same plane. Since the dimensions of electron beam transit hole 304 provided facing these elements and of its surrounding opposed walls 313 are the same in the Y direction along the long axis (FIG. 6) and in the X direction along the short axis (FIG. 7) of electron emission surface 301*a* of cathode 301 (i.e., Dx≃Dy), the equipotential planes 310 defined between the opposed elements are generally the same in both the X and the Y directions and the focal distance of the concave electron lens defined by the concavity here is the same for both the X direction and the Y direction.

Further, since focussing channel 305 has generally the same shape in the X direction and the Y direction (Sx≃Sy), the equipotential curves formed inside it have generally the same axially symmetric shape in the X and Y directions and so the convex electron lens defined by focussing channel 305 has the same focal distance in both the X and Y directions.

Therefore, the focal distance of the convex electron lens combined with the concave electron lens is generally the same in the Y direction as it is in the X direction.

Further, thermoelectrons emitted from electron emission surface 301*a* of cathode filament 301 are accelerated by a positive bias voltage imposed across electron emission surface 301*a* and electron beam transit hole 304 and move in the same direction to constitute a generally coherent stream. Thanks to the above, electrons exiting from focussing channel 305 are accelerated and focussed while constantly maintaining the same form of distribution and reach target 103. As a result, the X direction and Y direction lengths lx and ly of the electron beam incident on the surface 103*a* of target 103 always satisfy the relation $$\frac{ly}{lx} = \frac{Cy}{Cx} \tag{3}$$

where Cx and Cy are respectively the X direction and Y direction lengths of focussing channel 305. If the shape is made such that $$\frac{1}{\sqrt{2}\cdot\tan\theta} \leqq \frac{Cy}{Cx} \leqq \sqrt{2}\cdot\frac{1}{\tan\theta} \tag{4}$$

Eq. (2) is satisfied.

In particular if one sets $$\frac{Cy}{Cx} = \frac{1}{\tan\theta}$$

Eq. (1) is satisfied and one can produce and X-ray focal spot that is a polygonal shape, including a square, or is circular.

Since this relation is always maintained, even if the bias voltage is altered, it is possible to produce X-ray focal spots that are of different sizes but which always keep a similar shape simply by control of a single bias voltage.

Next, an example of actual operation will be described.

First, the filament, i.e., cathode 301 is heated directly by being supplied with heating power from a filament power supply 306. Operation is effected by electron beam forming electrode 303 being supplied with a bias voltage from a bias power supply 307 which is variable over the range 50–1000 V positive with respect to cathode 301 Anode target 103 is supplied with a positive voltage of about 30 k–120 kV with respect to cathode 301 from a power supply 308. As a result of this, the waist of electron beam e coincides with the target surface at a bias voltage of about 200 V.

The minimum size of the electron beam X-ray focal spot $e_o$ on target surface 103*a* was a short side of about 50 μm and a long side of about 125 μm, the effective X-ray focal spot Xo seen from the X-ray radiation axis X was an approximate square with a side of about 50 μm and a uniform electron density distribution was obtained.

Varying the bias voltage in the range 50–1000 V caused a change in dimensions from a side of about 50 μm to a side of about 1 mm, but with the shape of the X-ray focal spot kept generally the same.

Figure 9:
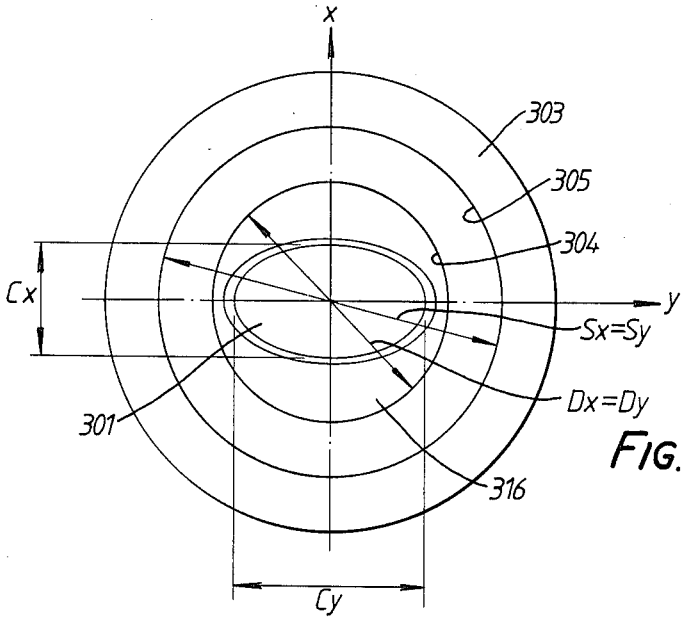
FIG. 9 is a plan view of the electron beam forming electrode, according to another embodiment of this invention.
Figure 10:
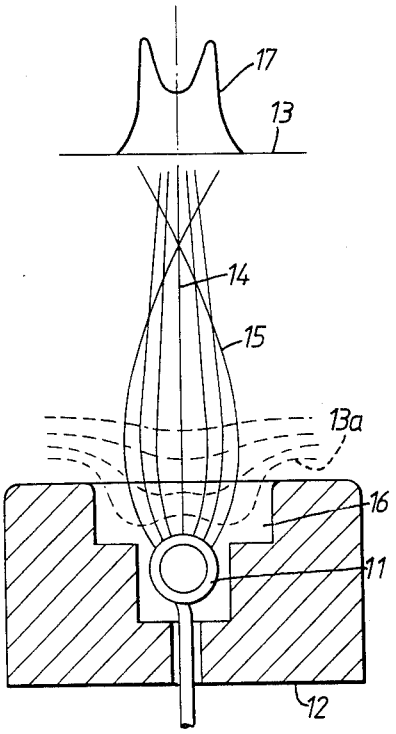
FIG. 10. (PRIOR ART)
FIG. 10 is a view in which the loci of electron beams, the equipotential lines ans the electron beam density distribution for explaining the operational mode in the conventional X-ray tube device.
Figure 11:
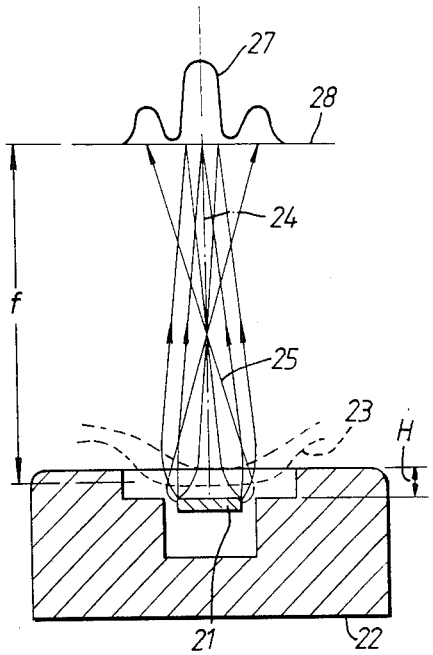
FIG. 11. (PRIOR ART)
FIG. 11 is a view, similar to FIG. 10, for explaining the operational mode in another conventional x-ray tube device.
Figure 12:
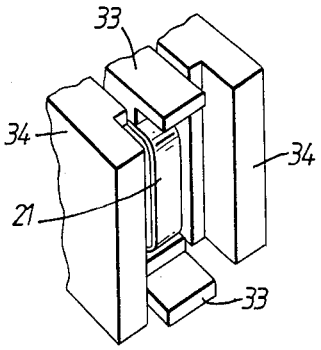
FIG. 12. (PRIOR ART)
FIG. 12 is a partial perspective view of a conventional cathode structure.
Figure 13:
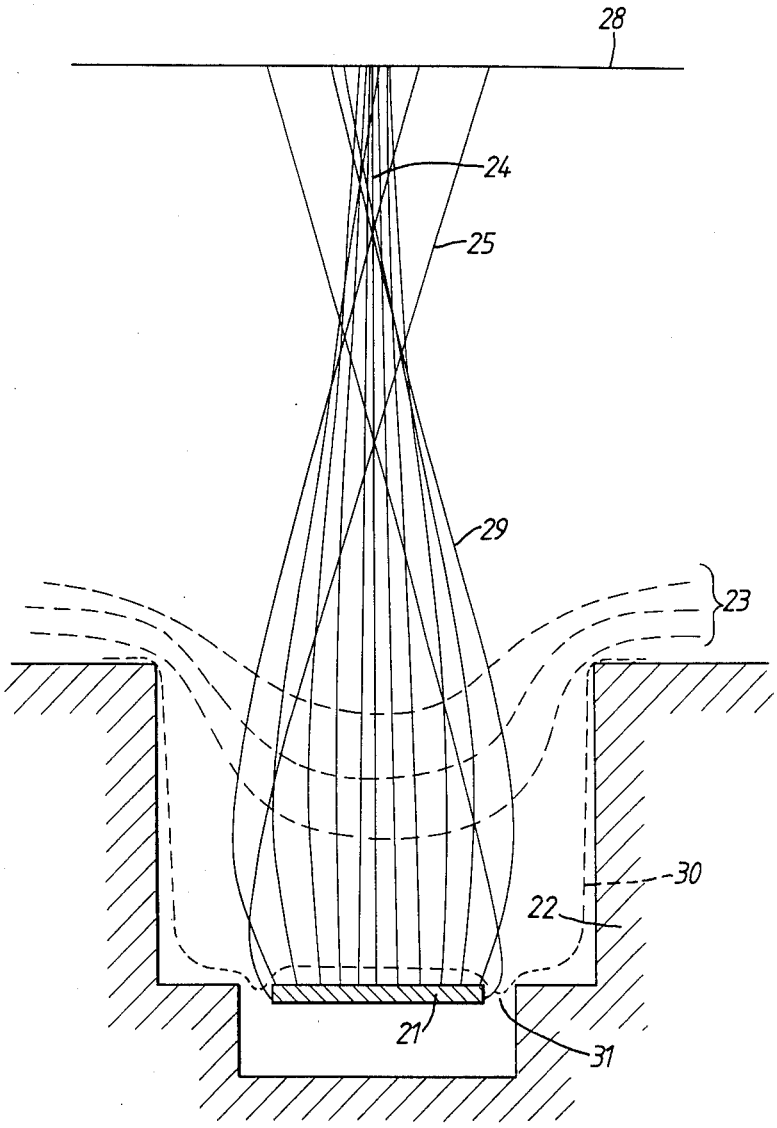
FIG. 13. (PRIOR ART)
FIG. 13 is a view in which the loci of electron beams, and the equipotential X-ray tube device.

To take an example where the area of electron emission surface 301*a* of cathode filament 301 is increased, application of the invention to an X-ray tube in which the anode voltage is made up to a maximum of 150 kV and the anode current is made up to a maximum of 1000 mA by changing the filament voltage 306 in according with X-ray focal spot size makes it possible to keep the effective X-ray focal spot long and short side ratio to about 1.4 or less. The relation between the bias voltage and the short side lx and long side ly of the electron beam just in front of the target surface 103*a* is as shown in FIG. 9 and the ratio of the effective X-ray focal spot's side ratio can be kept to around 1.4 or less.

Next, a method of increasing tube current in correspondence to X-ray focal spot size will be described.

The distance d1 between electron beam transit hole 304 and cathode 301 is set so that electrons exiting from cathode filament 301 operate in a temperature limited region as a result of the bias voltage. That is, the arrangement is such that the amount of electrons passing through electron beam transit hole 304 is determined solely by the temperature of cathode 301, while the magnitude of the electron density distribution on anode target 103 can be varied independently by the bias voltage.

Although a smaller X-ray tube X-ray focal spot gives better spascial resolution of X-ray image, sometimes, depending on the size or material of the photographed object, it is necessary to give preference to increasing the X-ray beam intensity to decrease photo noise. X-ray focal spot sizes and corresponding permissible X-ray beam intensities are in preset relations determined by the material or speed of rotation, etc. of target 103. Once the object which is wished to photograph is specified, therefore, the necessary tube current for it is determined and the minimum X-ray focal spot size possible with this current can be determined. Thus, it is always possible to achieve ideal resolution by changing the X-ray focal spot size in accordance with the object.

The invention offers the following advantages.

(1) The size of the X-ray focal spot can be controlled, with its shape always kept generally constant, solely by control of a single bias voltage. Also, the X-ray focal spot can be set to any size independently of the tube current.

(2) Sharp-edged X-ray focal spots with little aberration and of any size can be produced since electrons exiting from electron emission surface 301*a* of cathode filament 301 are accelerated by a positive bias voltage and move at uniform speed in a uniform direction.

(3) For the reasons noted in (2) above, it is possible to effect focussing down to a finer size than is possible conventionally and to provide an X-ray tube with a very small X-ray focal spot.

(4) Design and manufacture of the electron gun are extremely simple, since an axially symmetric structure is produced by making electron beam transit hole 304 and focussing channel 305 circular.

(5) If, in addition to (4) above, the shape of electron emission surface 301*a* of cathode filament 301 is made an ellipse with a major to minor axis ratio of $1/\tan\theta$, it is possible to produce a circular X-ray focal spot that is always axially symmetric and the resolution of images obtained using this is extremely good.

There now follows a description of another embodiment of the invention given with reference to FIG. 9.

Although both electron beam transit hole 304 and focussing channel 305 were made square in the previous embodiment described above, they may be both made circular as shown in FIG. 9. or polygonal shapes closer to circular than a square. The same advantages as in the previous embodiment are achieved here by making the minor axis Cx and major axis Cy of electron emission surface 301*a* of cathode filament 301 such that they satisfy the abovenoted expression of relation Eq. (3). In this case, the electron beam X-ray focal spot on anode target 103 has the shape of an ellipse whose major axis is $1/\tan\theta$ times its minor axis, and so the X-ray focal spot Xo seen from the X-ray tube's X-ray radiation direction is close to a true circle. If the bias voltage is changed, the X-ray focal spot changes in size but still retains the shape of an approximate circle. The abovenoted relation means that a generally circular shape is maintained even if the bias voltage or other design conditions are changed.

One can obtain required X-ray focal spot sizes despite changes in the tube current if one makes corresponding changes to the bias voltage.

Although electron beam transit hole 304 and focussing channel 305 were provided in a electron beam shaping electrode 303 constituted as an integral structure in the embodiments above, they may of course be mechanically separated and, of course, another bias voltage may be imposed between them.

A separate heating type element such as a barium impregnated cathode, etc. may be used as cathode filament 301. Also, the same advantages are achievable if the surface of the filament is curved.

As long as the difference between the X direction and Y direction focal distances is small, the same advantages are achievable even if a bias voltage lower than the bias voltage described earlier is applied cross cathode filament 301 and potential distribution flattening electrode 316 or if potential distribution flattening electrode 316 is shifted away from electron emission surface 301*a* a little.

I claim:

1. An X-ray tube device comprising:

an X-ray tube containing an evacuated envelope;

a cathode structure emitting electron beams within said evacuated envelope, comprising a cathode filament for emitting electrons and an electron beam forming electrode focussing said electrons; and an anode target having a target surface facing said cathode structure and inclined with respect to an X-ray irradiation axis, and emitting X-rays along said X-ray irradiation axis by bombardment of said electron beams; and means for applying voltages to said anode target and said electron beam forming electrode with respect to said cathode filament;

wherein said cathode filament has a flat electron emission surface extending longer in a first axis direction than in a second axis direction normal to the first axis direction, the first axis direction being substantially parallel to the direction of the X-ray irradiation axis, a potential flattening electrode separate from said electron beam forming electrode is located on substantially the same plane as said electron emission surface in the vicinity of said electron emission surface of said cathode filament and is substantially at the same potential as said cathode filament;

said electron beam forming electrode has an electron beam transit hole located in the vicinity of said cathode filament and a focussing channel extending toward said anode target from said transit hole having a shape larger than that of said transit hole, a surface of said electron beam transit hole and an opening of focussing channel defining circles or polygonal shapes having at least four sides;

the length in the second axis direction of the surface of said electron beam transit hole is longer than the length in the second axis direction of said electron emission surface of said cathode filament;

the length in the first axis direction of the surface of said electron beam transit hole is substantially equal to the length in the second axis direction; and the length in the first axis direction of the opening of said focussing channel is substantially equal to the length in the second axis direction.

2. The X-ray tube device as claimed in claim 1, wherein the surface of said electron beam transit hole and the opening of said focussing channel are similar to each other.

3. The X-ray tube device as claimed in claim 1 wherein, when the lengths of the long axis and the short axis of said cathode's electron emission surface are respectively designated as Cx and Cy and the angle of inclination of said target to the direction of X-ray irradiation is designated as $\theta$, the following relation holds:

$$\frac{1}{\sqrt{2}\cdot\tan\theta} \leqq \frac{Cy}{Cx} \leqq \frac{\sqrt{2}}{\tan\theta}$$

4. The X-ray tube device as claimed in claim 1, wherein a bias voltage that is positive with respect to said cathode is applied to said electron beam transit hole.

5. The X-ray tube device as claimed in claim 4, wherein the X-ray focal spot of a composite electron lens combining a concave electron lens which is defined by said cathode's electron emission surface, said potential flattening electrode around said electron emission surface and said electron beam transit hole having applied thereto a bias voltage which is positive with respect to said electron emission surface and said potential flattening electrode and a convex electron lens defined by said focussing channel lies on or to the rear of said anode target's surface.

6. The X-ray tube device as claimed in claim 4, wherein the X-ray focal spot size can be made greater by raising the bias voltage applied between said cathode and said electron beam transit hole and the tube current can be increased independently of the X-ray focal spot size by effecting corresponding increase of said cathode's temperature.

7. The X-ray tube device as claimed in claim 1, wherein said cathode's electron emission surface is elliptical and said electron beam transit hole and focussing channel are circular.

8. The X-ray tube device as claimed in claim 1, wherein said cathode is constituted by a thin flat plate of heavy metal.

* * * * *